US007443490B2

(12) United States Patent
Yamagishi et al.

(10) Patent No.: US 7,443,490 B2
(45) Date of Patent: Oct. 28, 2008

(54) MEDIUM DISCRIMINATION DEVICE, IMAGE FORMING APPARATUS, AND PROGRAM HAVING SIMPLIFIED MECHANISM

(75) Inventors: Masaru Yamagishi, Kanagawa-ken (JP); Nobuo Inoue, Kanagawa-ken (JP); Kouki Sakamoto, Kanagawa-ken (JP); Nobuyuki Shimodaira, Tokyo-to (JP); Takashi Koshinuma, Chiba-ken (JP); Yasuharu Gaman, Tokyo-to (JP); Katsuhiko Miki, Tokyo-to (JP)

(73) Assignee: Ricoh Co., Ltd., Tokyo (JP)

( * ) Notice: Subject to any disclaimer, the term of this patent is extended or adjusted under 35 U.S.C. 154(b) by 320 days.

(21) Appl. No.: 11/327,383

(22) Filed: Jan. 9, 2006

(65) Prior Publication Data

US 2006/0164456 A1 Jul. 27, 2006

(30) Foreign Application Priority Data

Jan. 7, 2005 (JP) ..... 2005-002278
Apr. 21, 2005 (JP) ..... 2005-123754
Sep. 30, 2005 (JP) ..... 2005-286983

(51) Int. Cl.
*G06K 9/74* (2006.01)

(52) U.S. Cl. ..... 356/71; 356/432

(58) Field of Classification Search ..... 356/71, 356/432

See application file for complete search history.

(56) References Cited

U.S. PATENT DOCUMENTS 5,769,407 A * 6/1998 Hansen ..... 271/3.03

FOREIGN PATENT DOCUMENTS

EP 1 081 074 A2 3/2001

(Continued)

OTHER PUBLICATIONS

Patent Abstracts of Japan, JP 06-056312, Mar. 1, 1994.
Patent Abstracts of Japan, JP 2003-137457, May 14, 2003.

*Primary Examiner*—Roy M Punnoose
(74) *Attorney, Agent, or Firm*—Oblon, Spivak, McClelland, Maier & Neustadt, P.C.

(57) ABSTRACT

A medium discrimination device includes a transmitted light quantity measurement device arranged to measure a transmitted light quantity in a thickness direction of a printing medium on a conveyance route, and configured to perform a measurement of the transmitted light quantity at each time the printing medium is conveyed, a measurement value memory device storing a result of the measurement performed by the transmitted light quantity measurement device, a medium setting device configured to previously set a type of printing medium to be used, a medium information memory device storing information of a transmitted light quantity assigned to each printing medium to be set by the medium setting device, and a control processing unit configured to perform paper type detection on a first printing medium, and double feed detection on following printing mediums.

31 Claims, 11 Drawing Sheets

FOREIGN PATENT DOCUMENTS

| | | |
|---|---|---|
| JP | 04-032441 | 2/1992 |
| JP | 2001-124514 | 5/2001 |
| JP | 2001-294344 | 10/2001 |
| JP | 3291065 | 3/2002 |
| JP | 2002-311753 | 10/2002 |
| JP | 2003-029581 | 1/2003 |
| JP | 2003-101720 | 4/2003 |

* cited by examiner

MEDIUM DISCRIMINATION DEVICE, IMAGE FORMING APPARATUS, AND PROGRAM HAVING SIMPLIFIED MECHANISM

CROSS-REFERENCE TO RELATED APPLICATIONS

This patent specification is based on Japanese patent applications, No. JPAP2005-002278 filed on Jan. 7, 2005, No. JPAP2005-123754 filed on Apr. 21, 2005, and No. JPAP2005-286983 filed on Sep. 30, 2005, in the Japanese Patent Office, the entire contents of each of which are incorporated by reference herein.

BACKGROUND OF THE INVENTION

1. Field of the Invention

The present invention relates to a medium discrimination device, an image forming apparatus, and a program product, and more particularly to a medium discrimination device, an image forming apparatus, and a program product for detecting a paper type and a double-feed of a medium on a conveyance route by using a simplified mechanism.

2. Discussion of the Background

A related art medium discrimination device is used in a sheet feeding unit for feeding a sheet of paper stored in a storage in a form of a plurality of overlaid sheets by sequentially separating the sheet to supply into a predetermined position. The medium discrimination device is used in, for example, a sheet feeding unit in an image forming apparatus such as a copier, a printer, a press machine, a feeding and conveyance unit in a document conveyance unit, and a document feeding and conveyance unit in a scanner. Detection of a paper type in the sheet feeding unit is performed for setting an optimum condition, since the optimum condition related to a copy condition, a print condition, a press condition, a document read condition differs depending on a type of a medium. A method of manually performing the paper type detection by an input operation performed by a user and a method of automatically performing the paper type detection by detecting a sheet are known as a method of paper type detection.

Further, detection of double feed (two or more sheets being conveyed at the same time) in the sheet feeding unit is performed for the following reason. For example, when a double-feed occurs during image formation, overlaid sheets are separated in the middle of conveyance. As a result, the separated sheet may be wound around a transfer member or a fixing member, possibly causing significant damage on a machine. Even when the overlaid sheets are discharged without being separated, a user needs to check a batch of sheets after images are formed thereon to see whether or not any double-feed has occurred, thereby causing extra work. Especially when post processing, such as stapling has been finished, more effort and time are required. To avoid the trouble, when a double-feed occurs, image forming and other processing needs to be immediately stopped and a user needs to be informed of an occurrence of the double-feed. Detection of double feed is required to control the stopping and informing. Detection by using reflected light quantity or by using transmitted light quantity is known as a method of detecting double feed.

Among the above methods, the method of detecting a paper type by the input operation performed by a user may have a problem that the user erroneously sets paper information, or incorrectly sets a sheet in a tray. When such a wrong operation occurs, a type of sheet different from the set type of sheet that the machine recognizes is used. As a result, various troubles may occur such that image quality is lowered and a sheet jam is caused due to degradation of a fixing property and an incorrect transfer condition. According to an invention proposed in the related art, the input operation performed by a user and the automatic paper type detection are used in conjunction, and, as a result, the above troubles are less likely to occur. Other technologies have also been proposed. The input operation performed by a user has been in practical use, and described in other related art. Most of the related art, however, are related to individual functional improvement in either the paper type detection or the double feed detection.

SUMMARY OF THE INVENTION

An exemplary embodiment of the invention includes a medium discrimination device including a transmitted light quantity measurement device arranged to measure a transmitted light quantity in a thickness direction of a medium on a conveyance route, and configured to perform a measurement of the transmitted light quantity at each time the medium is conveyed, a measurement value memory device storing a result of the measurement performed by the transmitted light quantity measurement device, a medium setting device configured to previously set a type of medium to be used, a medium information memory device storing information of a transmitted light quantity assigned to each medium to be set by the medium setting device, and a control processing unit configured to perform paper type detection on a first medium, and double feed detection on following mediums.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
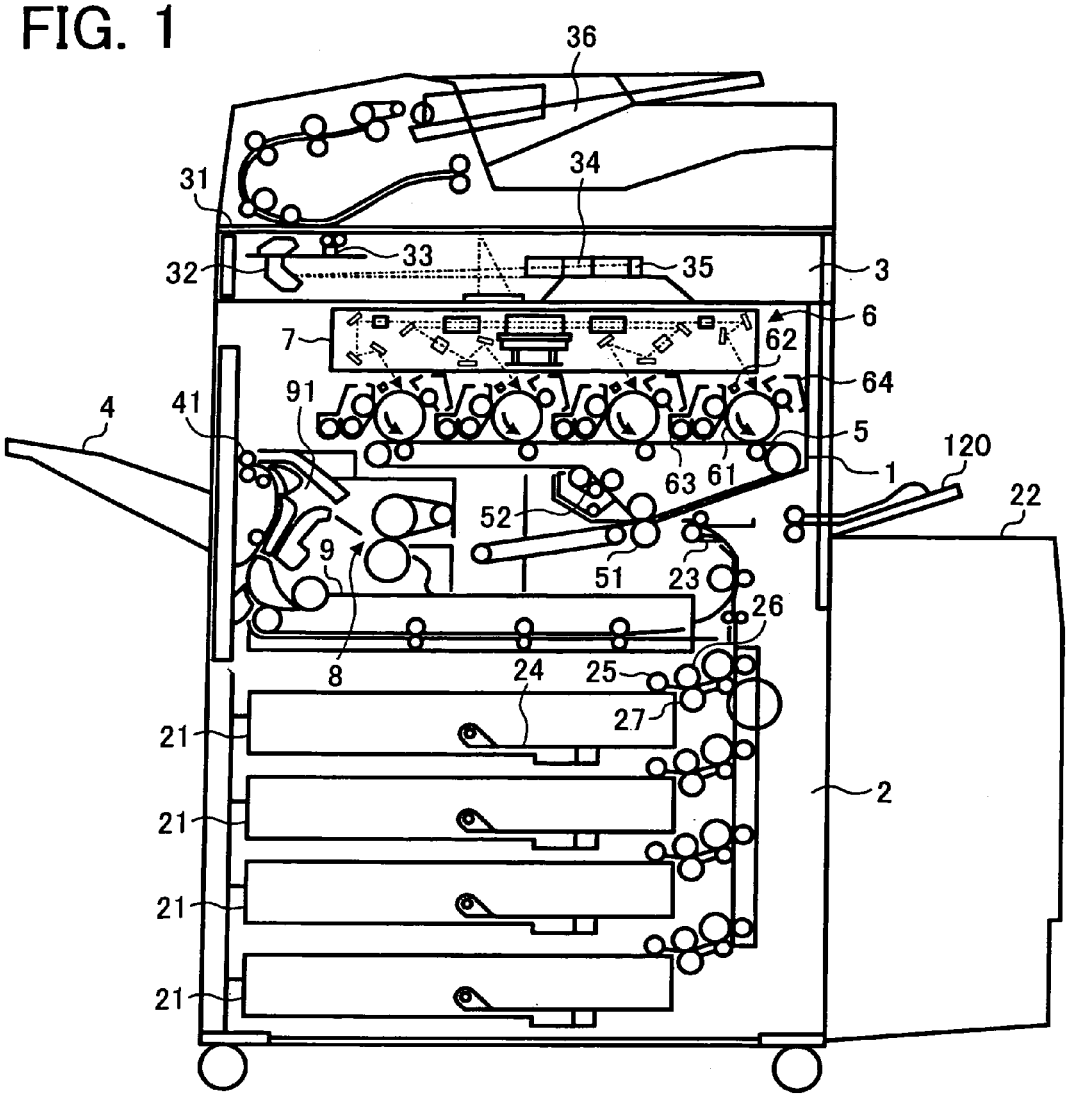
FIG. 1 is a schematic diagram of a copier according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a copier according to an exemplary embodiment of the present invention is described.

FIG. 1 is a schematic illustration of a general configuration of a copier 100 serving as an image forming apparatus including a sheet feeding unit 2 according to an exemplary embodiment of the present invention. The general configuration of the copier 100 is described below referring to FIG. 1.

As illustrated in FIG. 1, the copier 100 includes an image forming unit 1, the sheet feeding unit 2, a reading unit 3, a discharged sheet storage 4, a fixing unit 8, a duplex device 9, a registration roller 23, a sheet discharge roller 41, a branch part 91, and a manual feeding tray 120.

The image forming unit 1 includes an intermediate transfer belt 5 in an endless belt shape, four image forming devices 6 arranged in a line, an exposure device 7, four photoconductors 61 in a drum shape, four chargers 62, four development devices 63, and four cleaning devices 64.

The sheet feeding unit 2 includes a plurality of sheet feeding trays 21, a plurality of base plates 24, a plurality of pickup rollers 25, a plurality of sheet feeding rollers 26, and a plurality of reverse rollers 27.

The reading unit 3 includes an exposure glass 31, traveling bodies 32 and 33, a lens 34, and a CCD 35. The copier 100 further includes an automatic original conveyance device 36 disposed above the reading unit 3, and a transfer device 51 and a cleaning device 52 disposed around the intermediate transfer belt 5.

In general, the copier 100 has a function as a digital color copier for scanning an original to read image data of the original, and digitalizing the image data to copy to a sheet. Further, the copier 100 has a function as a facsimile machine for sending and receiving the image data of the original to and from a device installed at a distant location, and a function as a printer for printing the image data dealt by a computer on a sheet.

The image forming unit 1 in the copier 100 is provided substantially at a center thereof. The image forming unit 1 is provided with the sheet feeding unit 2 including a plurality of bays at a lower part thereof. Each of the plurality of sheet feeding trays 21 is disposed in one of the plurality of bays, and serves as a sheet feeding device. Each of the plurality of sheet feeding trays 21 rotatably supports corresponding one of the plurality of base plates 24 on which a batch of sheets being recording mediums, such as plain paper, OHP sheets, and second originals are loaded. The sheet feeding trays 21 can be individually attached to and detached from a main body of the copier 100, and the main body is provided with a sensor (not shown) to detect attachment and detachment of the sheet feeding trays 21. The registration roller 23 is arranged in a downstream direction of a conveyance route of the sheets. The sheet feeding unit 2 is configured to be able to add another sheet feeding device 22 as necessary.

The image forming unit 1 is further provided on a right side thereof with the manual sheet feeding tray 120 which can be opened and closed. As shown in FIG. 1, a batch of sheets can be loaded on the manual sheet feeding tray 120 with an upper portion pulled and opened so as not to contact the main body.

The image forming unit 1 is further provided with a sensor (not shown) for detecting presence of a sheet on the manual sheet feeding tray 120. The reading unit 3 for reading an original is arranged at an upper portion of the image forming unit 1. The image forming unit 1 is further provided on a left side thereof with the discharged sheet storage 4 for storing a discharged sheet after an image is formed thereon.

The image forming devices 6 for forming yellow, magenta, cyan, and black toner images are arranged in a line from left to right in order, and face an outer circumference surface of the intermediate transfer belt 5. Each of the image forming devices 6 includes corresponding one of the photoconductors 61, and individually forms a toner image in corresponding one of the four colors.

Each of the image forming devices 6 further includes one of the chargers 62 for charging a surface of the photoconductor 61, and the exposure device 7 for irradiating the surface of the photoconductor 61 with a laser beam according to image information, both arranged around the photoconductor 61 included therein. Further, the development device 63 for visualizing an electrostatic latent image formed on the exposed surface of the photoconductor 61, and the cleaning device 64 for removing and recovering residual toner on the photoconductor 61 are also arranged around the photoconductor 61.

Each of the traveling bodies 32 and 33 in the reading unit 3 include a light source for illuminating an original (not shown), and a mirror (not shown). The traveling bodies 32 and 33 are arranged so as to be able to travel back and forth to scan the original placed on the exposure glass 31. The image information scanned by the traveling bodies 32 and 33 are read as an image signal by the CCD 35 disposed in a rear direction of the lens 34. The image signal is digitalized and subjected to image processing.

The exposure device 7 in the image forming unit 1 includes a laser diode LD (not shown) for emitting light according to the image signal so that an electrostatic latent image is formed on the surface of the photoconductor 61. The light emitted from the laser diode LD reaches the surface of the photoconductor 61 via a polygon mirror and a lens. The automatic original conveyance device 36 automatically conveys the original onto the exposure glass 31.

The transfer device 51 transfers a full color toner image formed on the intermediate transfer belt 5 onto a sheet. The cleaning device 52 removes and recovers residual toner on a surface of the intermediate transfer belt 5 after the full color toner image is transferred onto the sheet by the transfer device 51.

The fixing unit 8 is arranged in the downstream direction of the conveyance route of the sheets.

Next, a process of an image forming operation of the copier 100 is described below. In FIG. 1, four toner images in yellow, magenta, cyan, and black are formed in a predetermined timing as the intermediate transfer belt 5 rotates according to an electrophotographic process. Specifically, in the image forming devices 6 for the four colors, the four toner images in the respective colors are formed on the respective photoconductors 61. Then, the yellow, magenta, cyan, and black toner images are sequentially transferred onto the intermediate transfer belt 5 in the order so that the magenta toner image is superimposed on the yellow toner image, the cyan toner image is further superimposed thereon, and the black toner image is further superimposed thereon, thereby forming a full color toner image.

Meanwhile, in parallel to the forming of the full color toner image on the intermediate transfer belt 5, a sheet is sequentially separated from the batch of sheets loaded on selected one of the base plates 24 in the sheet feeding trays 21, and is fed. As the base plate 24 rotates, the sheet, on top of the batch of sheets, is elevated to a position in which the sheet can contact the pickup roller 25. The sheet on top is fed, as the pickup roller 25 rotates, and is separated from the rest of the batch of sheets by the reverse roller 27. Then, the separated sheet is picked out of the sheet feeding tray 21 as the sheet feeding roller 26 rotates, and conveyed to the registration roller 23.

Conveyance of the separated sheet is temporarily stopped when the sheet comes to abut against a nip of the registration roller 23, and is caused to wait. The registration roller 23 is controlled so as to start rotation with timing in which the full color toner image formed on the intermediate transfer belt 5 and a leading edge of the sheet meet a predetermined positional relationship. As the registration roller 23 rotates, a feeding operation of the waiting sheet is resumed. As a result, the full color toner image formed on the intermediate transfer belt 5 is transferred by the transfer device 51 in a predetermined position on the sheet.

The sheet on which the full color toner image is transferred, as described above, is fed to the fixing unit 8. The fixing unit 8 fixes the transferred full color toner image to form a full color image on the sheet. The sheet having the full color image thereon is discharged into and stored in the discharged sheet storage 4.

In a case of duplex image forming, the conveyance route of the sheet branches at the branch part 91 toward the duplex device 9, and the duplex device 9 turns the sheet upside down when the sheet passes therethrough. Then, the reversed sheet comes to abut against the nip of the registration roller 23 so that skew is corrected, and another image is formed on a back side of the sheet as on the frontside thereof.

Figure 2:
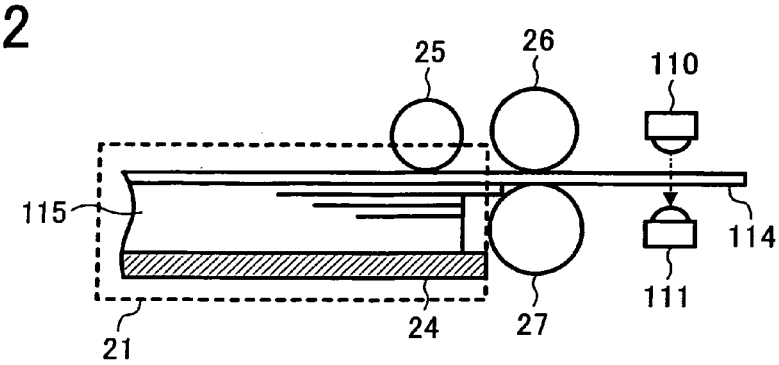
FIG. 2 is a schematic illustration of an example configuration of mechanical components of a medium discrimination device included in the copier shown in FIG. 1.

Next, a medium discrimination device being a characteristic part of the exemplary embodiment is described below. FIG. 2 is a schematic illustration of an example configuration of mechanical components of the medium discrimination device. The medium discrimination device includes the sheet feeding tray 21, the base plate 24, the pickup roller 25, the sheet feeding roller 26, and the reverse roller 27 illustrated in FIG. 1. The medium discrimination device further includes a transmitted light quantity measurement device having a light emitting device 110 and a light receiving device 111. Reference numerals 114 and 115 represent a sheet and a batch of sheets, respectively.

The light emitting device 110 and the light receiving device 111 are disposed in the downstream of the conveyance route of the sheet to measure a quantity of transmitted light of the sheet 114 every time the sheet 114 on top of the batch of sheets 115 loaded on the base plate 24 is conveyed thereto. The transmitted light quantity measurement device may be disposed at any location as long as the location is on the conveyance route ranging from the sheet feeding device to the image forming unit 1. In a case the copier 100 has a plurality of conveyance routes, the transmitted light quantity measurement device may be disposed in the vicinity of the registration roller 23 where the plurality of conveyance routes meet from a financial point of view.

The light emitting device 110 outputs a predetermined quantity of light. The light receiving device 111 detects the quantity of the output light. The light emitting device 110 and the light receiving device 111 are arranged so as to sandwich the sheet 114 being an object of discrimination so that a quantity of transmitted light in a thickness direction of the sheet 114 can be measured. In the exemplary embodiment of the present invention, controllers each taking care of either the light emitting device 110 or the light receiving device 111 are provided. The quantity of transmitted light of a medium being conveyed is measured to detect a type of the medium and a state of the medium to check whether or not double feed is caused based on a level of the quantity of light.

Figure 3:
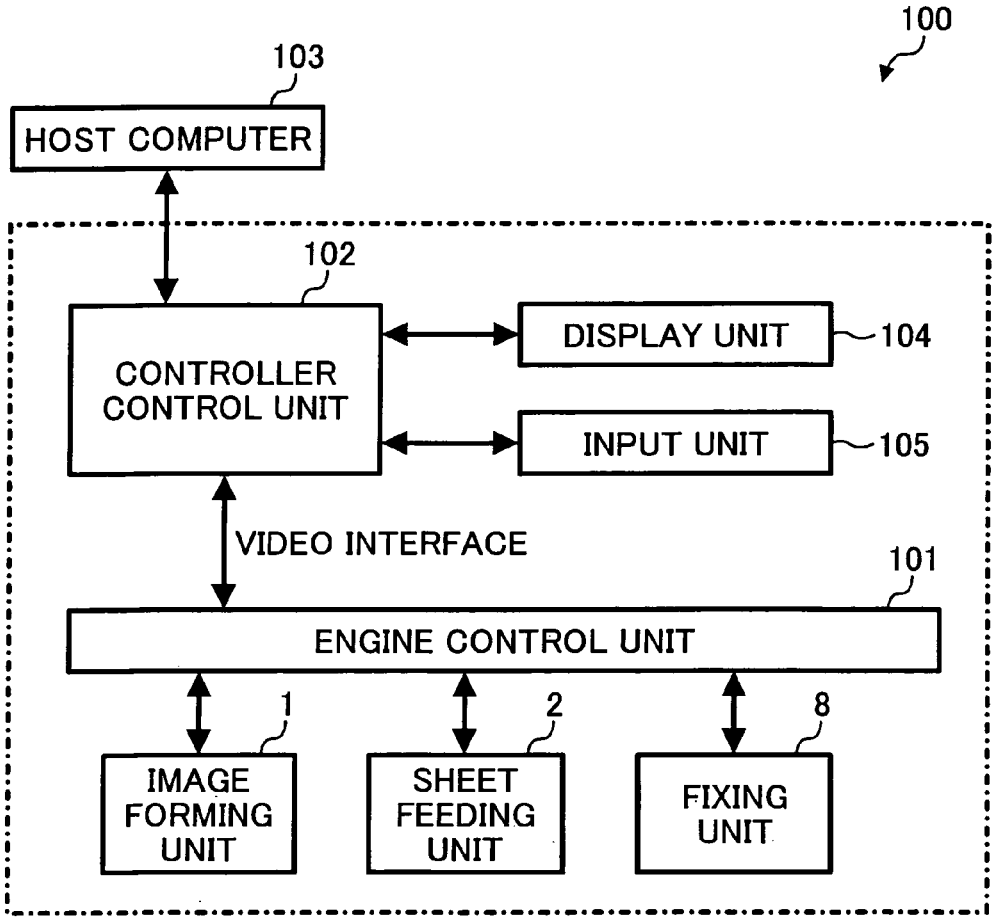
FIG. 3 is a block diagram of a copier and main control units included therein.

FIG. 3 is a block diagram of the copier 100 and of which main control units. The copier 100 includes the image forming unit 1, the sheet feeding unit 2, and the fixing unit 8 illustrated in FIG. 1. The copier 100 further includes an engine control unit 101, a controller control unit 102, a display unit 104, and an input unit 105. The engine control unit 101 is connected to the image forming unit 1, the sheet feeding unit 2, and the fixing unit 8, and mainly performs basic control thereof. The controller control unit 102 is connected to an external host computer 103, the engine control unit 101 via a video interface, the display unit 104, and the input unit 105. The controller control unit 102 acquires and manages external information required for each operation, provides necessary information to the engine control unit 101, and manages operation of an entire system. The display unit 104 may include a display of an operation panel. The input unit 105 may include an operation button arranged on the operation panel. In addition, or alternatively, the input unit 105 may partially or entirely include a touch panel when the display includes the touch panel.

A memory (a medium information memory device and a measured value memory device) for managing various types of information and various determination devices (processing units) in the medium discrimination device may be incorporated into any one of control parts or two or more of memory parts or processing parts included in the engine control unit 101, the controller control unit 102, and the sheet feeding unit 2. A medium setting device for previously setting a type of paper to be used may include the input unit 105, a control program recorded in a predetermined memory part for causing the memory part serving as the medium information memory device to memorize contents of the setting, and a processing device for causing executing of the control program. The control program may be configured to provide a user with guidance on a setting operation by showing specific information on the display unit 104. The medium setting device further includes the display unit 104 as a component. As a specific configuration of the medium setting device, the above described related art and a disclosed art in patent documents 2 and 3 may be used. The control program included in the medium setting device and a processing part for executing the control program are also incorporated into any one of the control parts or two or more of the memory parts or the processing parts included in the engine control unit 101, the controller control unit 102, and the sheet feeding unit 2.

The memory can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewriteable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

The control may be implemented on a programmed general purpose computer. However, the control may also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 4A, 4B, 6, 7A, 7B, and 10, can be used to implement the control.

Figures 4, 4A, 4B:
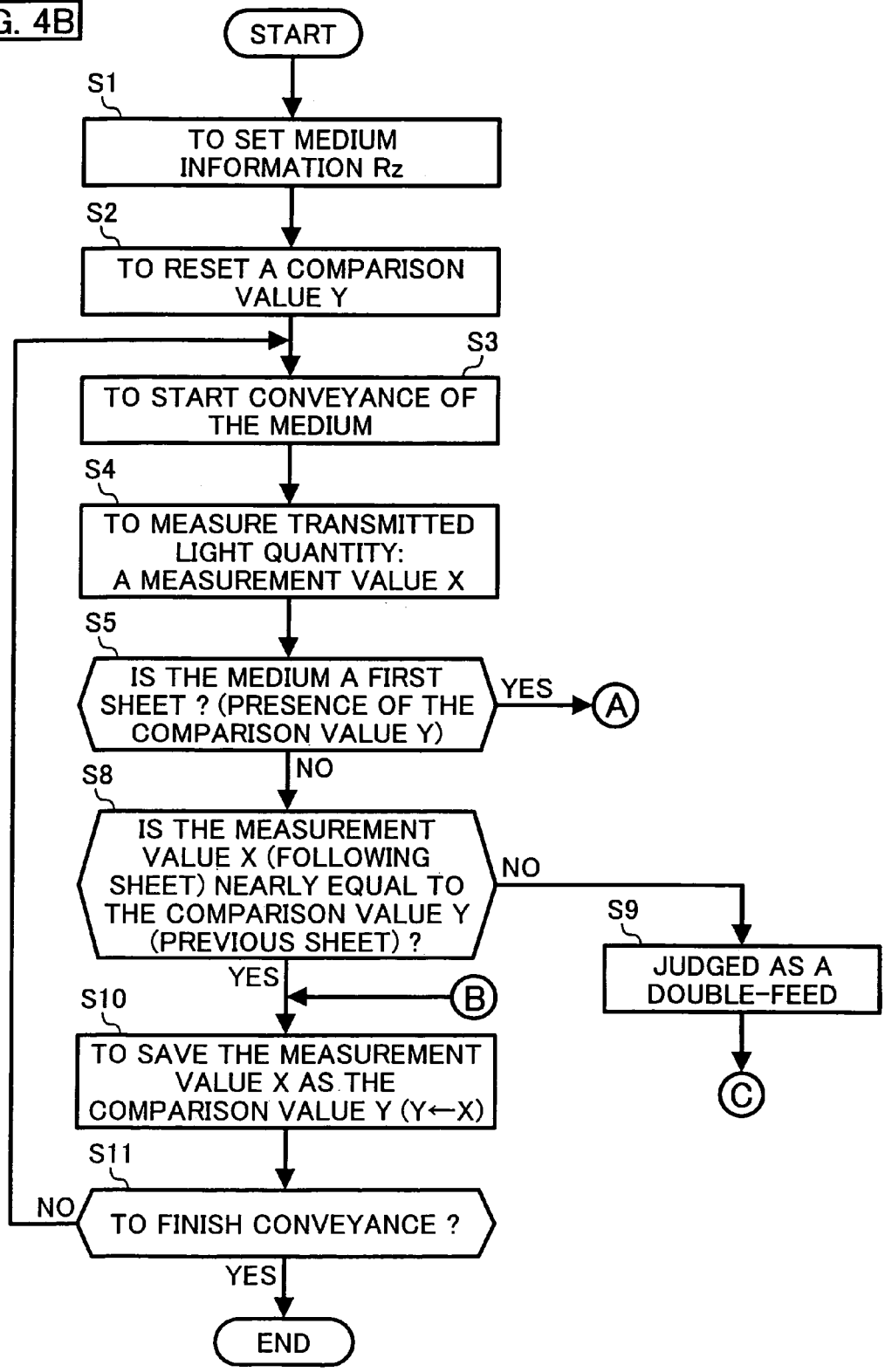
FIG. 4 is a flowchart showing how medium discrimination is controlled.
Figure 4B:
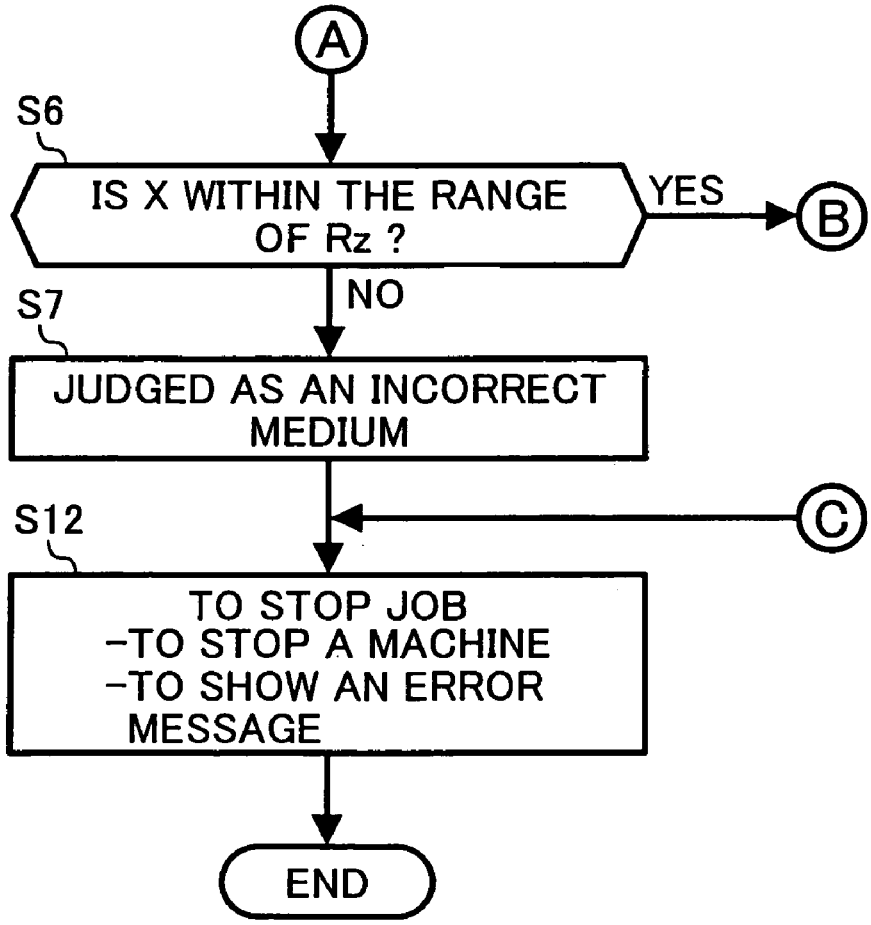

FIG. 4 is a flowchart showing how medium discrimination is controlled. At first, a type of paper to be used is selected (set) by the medium setting device (step S1). Based on the setting, range value information (R1 to R4) corresponding to the selected paper type is called from a transmitted light quantity table (for example, a table having contents shown in table 1) for each medium previously stored in the medium information memory device, and set as a comparison value (range value) Rz for medium type detection (step S1). In the step, the range value Rz is used to avoid having a great amount of information and complexity of managing the information by dealing a wide range of mediums as "plain paper", for example, as long as transmitted light quantities fall in a specific range, because there are many and various types of mediums labeled as plain paper in the market.

TABLE 1

| Paper type setting | Range value Rz of transmitted light quantity | Transmitted light quantity |
|---|---|---|
| OHP | R1 | ↑ High |
| Second original | R2 | \| |
| Plain paper | R3 | \| |
| Thick paper | R4 | ↓ Low |

After medium information is set, a comparison value Y is reset (step S2). The comparison value Y keeps a transmitted light quantity of a medium subjected to measurement at a last time, and is a comparison parameter to be used for detecting double feed. Next, after conveyance of a medium is started in certain timing (step S3), measurement of a transmitted light quantity of the medium is performed in a predetermined timing, and a measured value is temporarily stored as a measurement value X in memory (step S4).

Next, whether or not the medium being conveyed is a first sheet is judged. Based on a result of the judgment, it is determined if paper type detection or double feed detection is performed. As shown in step S5, the judgment is made based on whether or not a value has been set to the comparison value Y. Normally, when the medium is the first sheet, in the timing when the medium information is set (step S1) in a preparatory operation before starting the conveyance, the comparison value Y is reset (comparison value Y=NULL)(step S2), and therefore, the medium can be recognized as the first sheet. In the case, the medium is determined to be subjected to the paper type detection, and a routine in step S6 is performed.

In a case it is considered that the paper has been replenished because the paper has been used up, or that the paper setting has been reset, it is not known whether paper to be supplied is the same level of paper as the previous paper. In other words, when it is considered that the replenishment or reset has occurred in one of the sheet feeding trays 21 and the manual feeding tray 120 in the sheet feeding unit 2, specifically, in timing when detachment and attachment of the sheet feeding tray 21 is detected, or presence of paper is detected after absence of paper is detected in the manual feeding tray 120, the type of paper therein may possibly be changed. Therefore, it is preferable that the comparison value Y be reset in the timing. Further, in timing when power supply to a main body of the copier 100 is cut off and when the power supply is recovered after the cutoff, paper in the manual feeding tray 120 may possibly be replaced. Therefore, the comparison value Y may be reset in the timing. A reset mechanism includes control of the reset, the program in step S2 and the processing part for executing the program.

Next, in step S6, a comparison between the measurement value X and the range value Rz is performed. When the measurement value X is within a range represented by the range value Rz, the measured sheet and the paper setting are determined to be the same. In the case, the measurement value X is set as the comparison value Y (step S110), and the conveyance is continued. In step S6, when the measurement value X is out of the range represented by the range value Rz, the measured sheet and the paper setting are determined to be not the same. In the case, the conveyance is stopped, and an alarm to the extent that "the setting is incorrect" or "the paper set is incorrect" is raised (step S12).

The comparison value Y set in step S110 corresponds to a result of measurement to be stored in the measurement value memory device. A memory part which stores the comparison value Y corresponds to the measurement value memory device.

When it is judged that the conveyance is to be continued in step S11, the flow goes back to step S3 again, and measurement of the transmitted light quantity of a next sheet is performed (step S4). Then, as the comparison value Y being the measurement value of the previous sheet has been set, it is determined to be the measurement of the second sheet, and the flow goes to a step of double feed detection (step S8). In the step, a comparison between the comparison value Y (of the previous sheet) and the following measurement value X (of the following sheet) is performed. Generally, the transmitted light quantity in a case a double-feed occurs theoretically decreases to or below a half of the transmitted light quantity of a single sheet, and based on the theory, the double-feed is detected. The comparison value Y has a range of values in consideration of variations of the measurement value of a single sheet. For example, when the measurement value of the previous sheet is X, the comparison value Y is set to be X±30%, thereby ensuring not to incorrectly detect a single sheet. When the measurement value X greatly differs from the comparison value Y (a great decrease), it is judged that a double-feed has occurred (step S9 for N in step S8). In the case, the conveyance is stopped, and an alarm to the extent that a double-feed has occurred is raised (step S12). The above steps are repeated thereafter. During the repetition, as steps S4 and S110 are also repeated, the measurement value memory device rewrites data in the memory each time the transmitted light quantity measurement device measures a sheet.

When a series of conveyance operations is correctly finished, the comparison value Y is not reset thereafter for simplification of control unless the paper setting is changed or the paper is changed.

Normally, since a great amount of sheets can be supplied at one time into a paper tray of a copier, once paper type detection of a first sheet is performed, even when a printing operation (normal end) is repeated many times, only performing the double feed detection of a second sheet and thereafter may satisfy requirements as a system unless setting of a paper type is changed, or paper is replaced.

According to the above control flow, it is possible to make a judgment on selection between two modes (mode judgment). One mode, which is a paper type detection mode in which the paper type detection is performed, is selected when a sheet is determined to be the first sheet. The other mode, which is a double feed detection mode in which the double feed detection is performed, is selected when the sheet is determined to be the second sheet and thereafter.

In addition to the above control for medium discrimination, the copier, according to the exemplary embodiment of the present invention, performs control for modifying image forming conditions in accordance with a type of paper to be used for copying. Specifically, an amount of heat is modified (variable according to a light quantity of a lump and a sheet conveyance speed in a fixing operation) in a case at least heat is used for a fixing device, transfer electric field strength to be used for transfer is modified, and a sheet conveyance speed and a sheet interval are modified (which is also related to modification of an amount of heat for fixing). Instead thereof, or in addition thereto, other image forming conditions may also be modified. For recognition of a type of paper to be used for controlling of the modification, the result of setting in step S1 can be used. Since the sheet feeding unit 2 includes the multi-layered plurality of sheet feeding trays 21 and the manual feeding tray 120, a memory space for storing a type of set paper is allocated for each of the trays. When one of the trays is selected for use, the type of paper stored in the corresponding memory space is read, and the image forming conditions are modified to best suit to the type. For the modification, optimal image forming conditions for each of the paper types are stored in the memory in a form of a table.

According to the copier 100 of the exemplary embodiment of the present invention as described above, the paper type detection is performed on the first sheet being conveyed, and the double feed detection is performed on the following sheets, thereby sharing a single detection mechanism. As a result, the simplified mechanism achieves a reduction in the cost.

Further, depending on whether or not the measurement value of the previous sheet is present, the paper type detection mode and the double feed detection mode are selectively performed (the mode judgment mechanism), thereby achieving simplification of the control. As a result, improvement in reliability as a system can be achieved.

Although the present invention is, in the above exemplary embodiment, applied to the sheet feeding device of the copier as an example, the present invention may also be applied to a document feeding device in the automatic original conveyance device 36 of the copier. Alternatively, the present invention may also be applied to a printer, a press machine, or a scanner.

Next, another exemplary embodiment of the present invention is described below. A copier 200 according to the exemplary embodiment of the present invention is based on the copier 100 according to the previous exemplary embodiment, so as to be able to separately turn on and off each of medium discrimination modes (the paper type detection mode and the double feed detection mode). The copier 200 includes at least two or more medium trays, and medium information memory devices individually managed for each of the medium trays.

As shown in table 3, a plurality of types of mediums can be managed as a system such that, for example, OHP is set in the sheet feeding port 1: Rz1, thick paper is set in the sheet feeding port 2: Rz2, and so forth. The two or more medium trays may be the manual feeding tray 120 shown in FIG. 1, a sheet feeding tray in a main body of the copier, and, further, the multi-layered trays 21 in the sheet feeding unit 2. The sheet feeding unit 2 may be integrated in the main body of the copier, or alternatively, be configured as a large capacity medium feeding device to be optionally attached.

A schematic configuration of the copier 200 is the same as the schematic configuration of the copier 100 shown in FIGS. 1 and 2.

Figure 5:
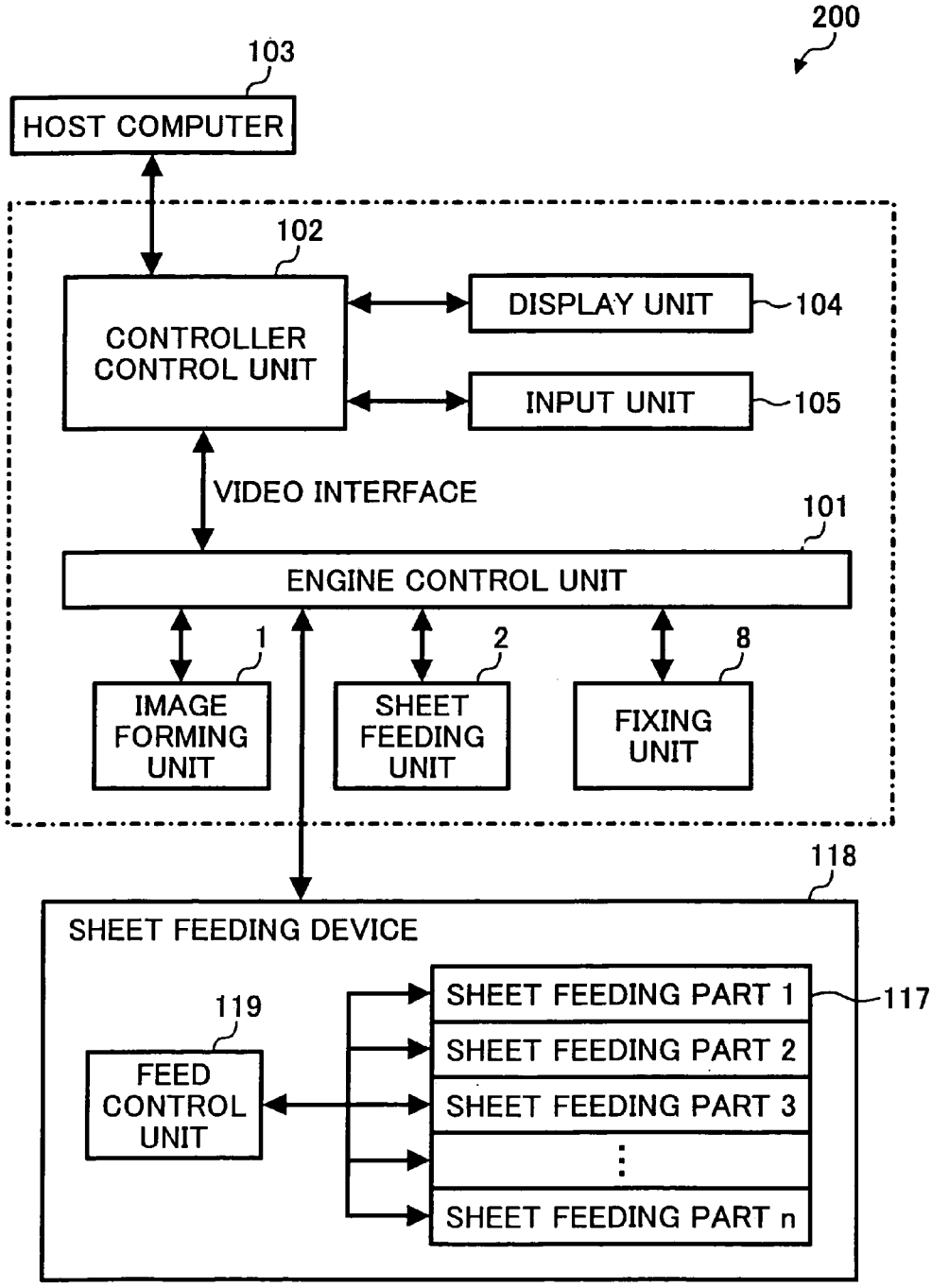
FIG. 5 is a block diagram of electrical components of a copier according to another exemplary embodiment of the present invention.

FIG. 5 is a block diagram of electrical components of the copier 200 in a case the sheet feeding unit 2 is provided as the large capacity medium feeding device. The same electrical components as the electrical components in FIG. 3 have the same reference numerals as in FIG. 3. A sheet feeding device 118 includes a medium feeding device 117 and a feed control unit 119. The medium feeding device 117 includes sheet feeding parts 1 to n each having a medium feeding mechanism including the pickup roller 25, sheet feeding roller 26, and the reverse roller 27 shown in FIG. 2.

The feed control unit 119 controls the medium feeding device 117. The medium feeding device 117 feeds a medium, and controls conveyance of the medium under the control of the feed control unit 119. The above medium information memory device may include the memory for storing the type of paper set for each of the trays in the copier 100 according to the previous exemplary embodiment of the present invention.

Figure 6:
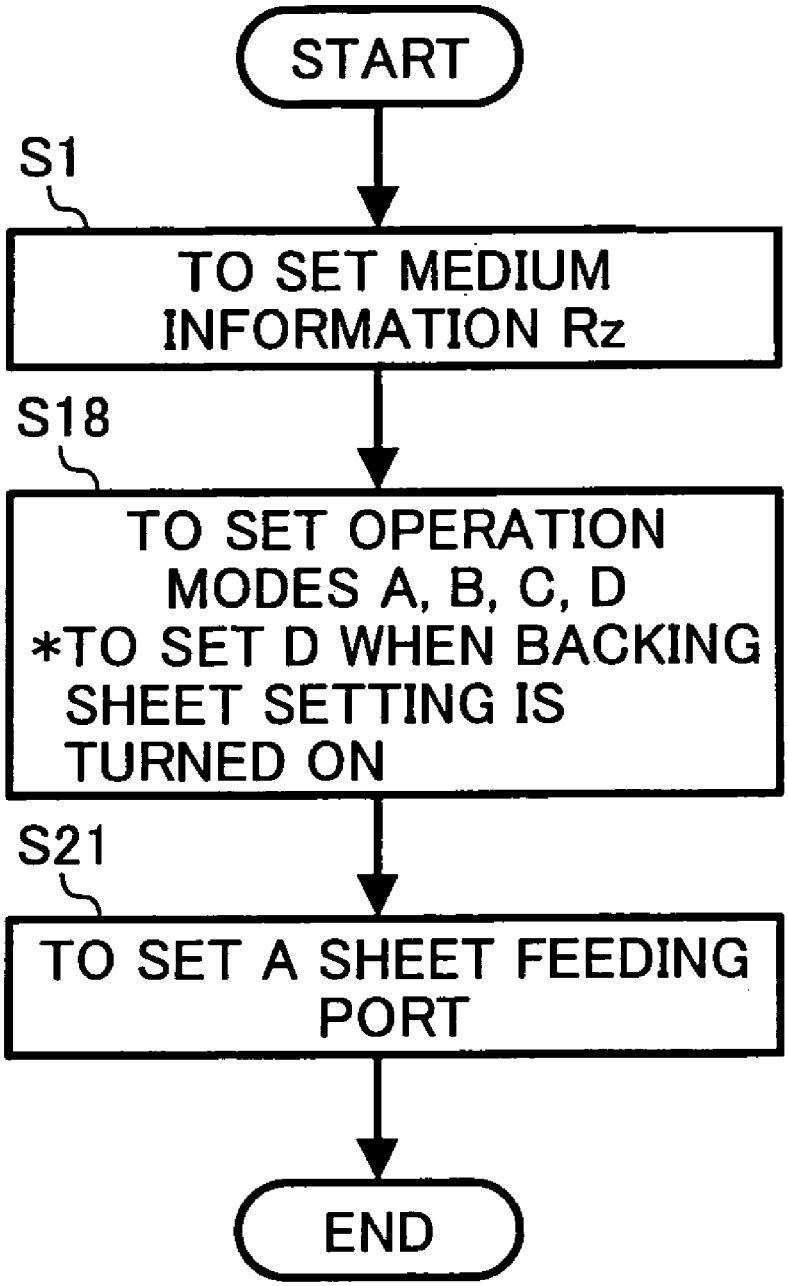
FIG. 6 is a flowchart of control for setting detection conditions of the copier in FIG. 5.
Figure 7A:
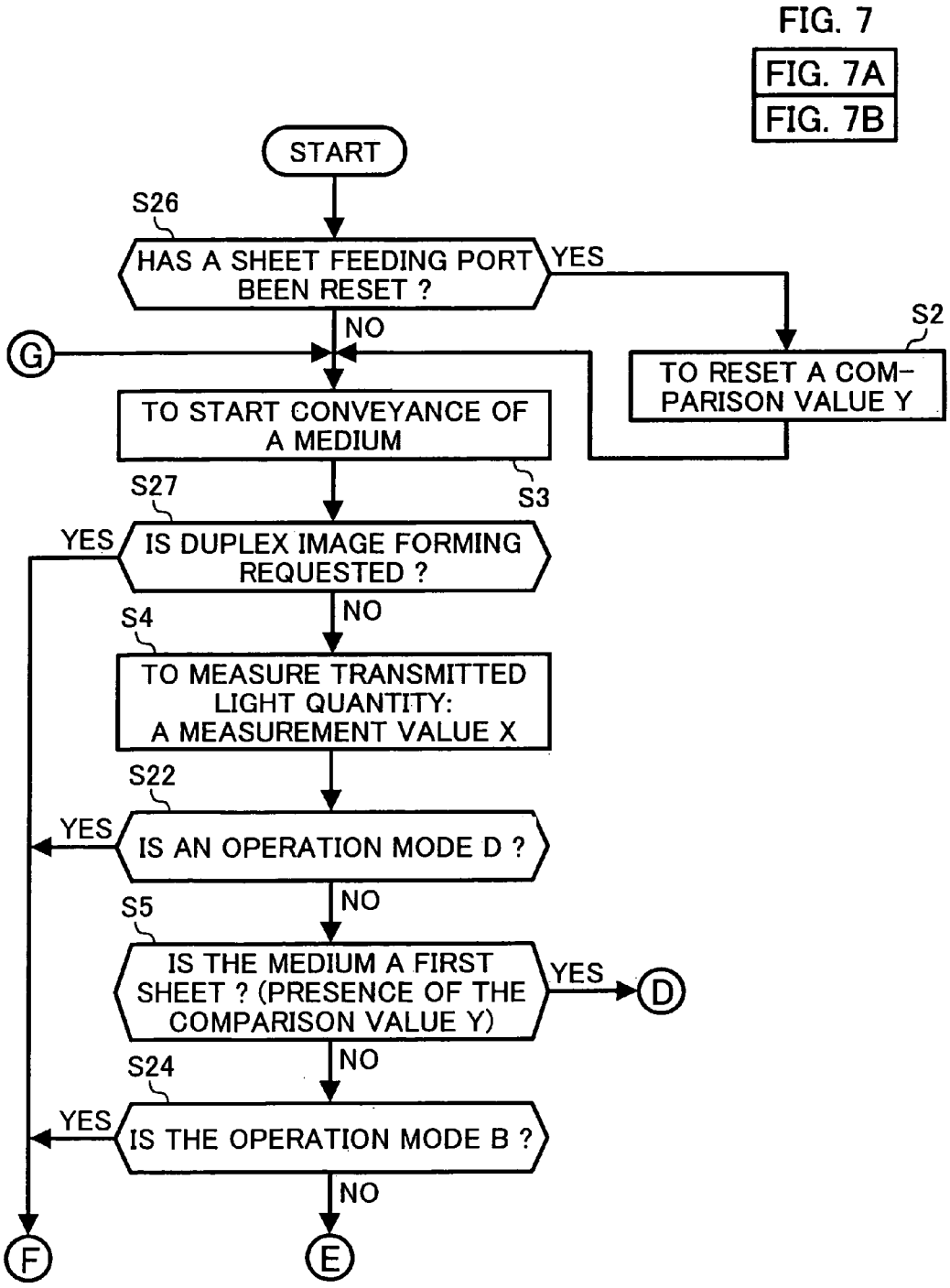
FIG. 7 is a flowchart of control of the copier in FIG. 5.
Figure 7B:
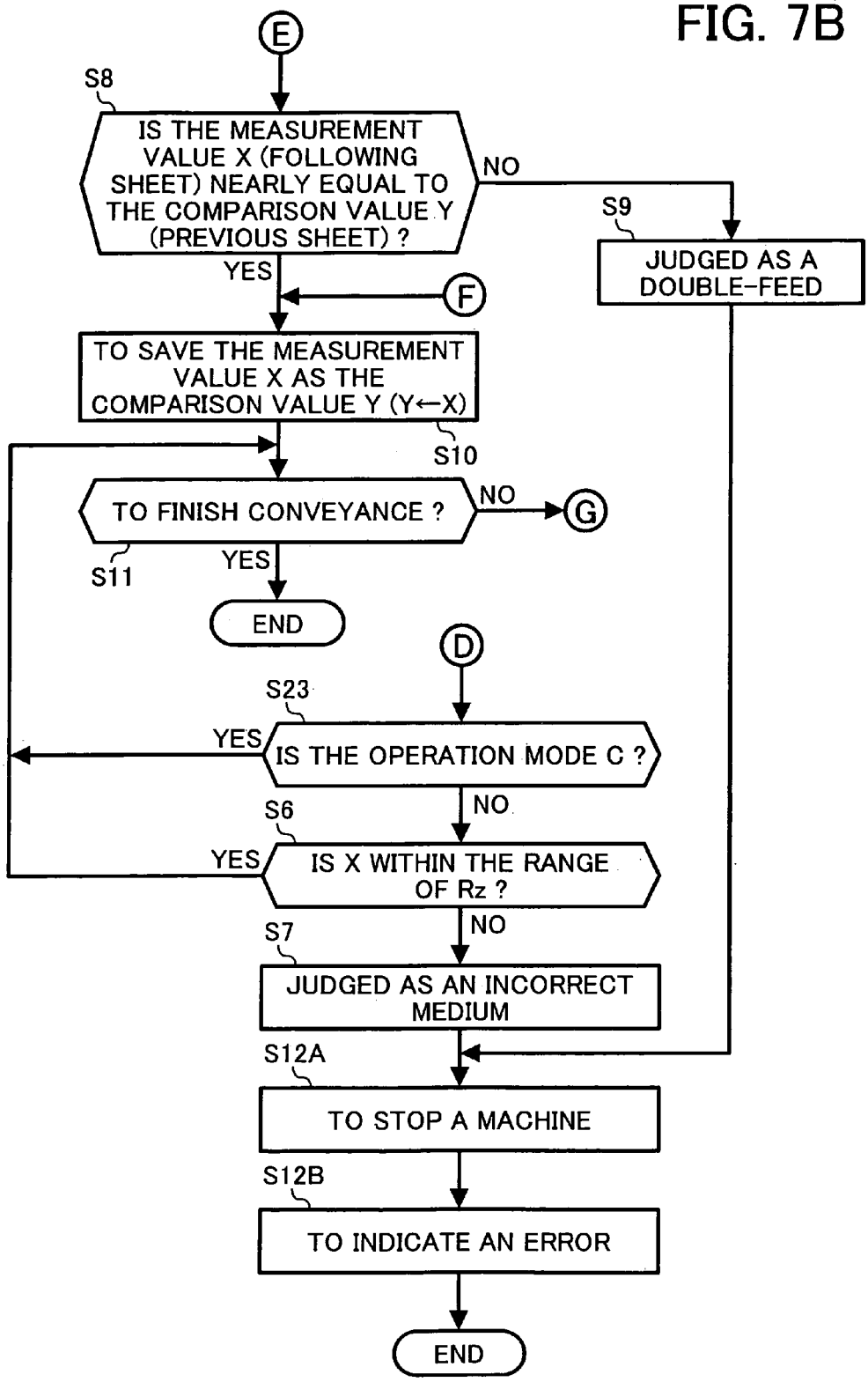

FIGS. 6 and 7 are flowcharts of control of the copier 200 according to the exemplary embodiment of the present invention.

As there are many and various types of mediums in the market, a user may have such a need that the user necessarily wants to convey a sheet of which type cannot be discriminated. By providing the user with an option of selecting whether or not to detect the sheet improves ease of use (degree of freedom) of a system. Specifically, a paper type detection switch device and a double feed detection switch device are provided (turn on: to detect, turn off: not to detect). Based on a combination thereof, operation modes A to D as shown in table 2 are determined (step S18 in FIG. 6). The various switch device including a transmittance information setting device, a paper type detection switch device, a double feed detection switch device, and a backing sheet setting device may include a press button in a display panel to be operated by a user and/or a display panel in a touch panel system also serving as an input device. The flow in FIG. 6 is started by a start instruction from such an operation device. An input device for setting a sheet feeding port (not shown) in step S21 is similarly configured. Further in table 2, a state of "a backing sheet setting" being on and off is also shown, which is described later.

TABLE 2

| | Operation mode | | | |
|---|---|---|---|---|
| | A | B | C | D |
| Sheet feeding port 1 | | | | |
| Paper type detection | To be detected | To be detected | Not to be detected | Not to be detected |
| Double feed detection | To be detected | Not to be detected | To be detected | Not to be detected |
| Backing sheet setting | No | | | |
| Sheet feeding port 2 | | | | |
| Paper type detection | To be detected | To be detected | Not to be detected | Not to be detected |
| Double feed detection | To be detected | Not to be detected | To be detected | Not to be detected |
| Backing sheet setting | No | | | |

TABLE 2-continued

| | Operation mode | | | |
|---|---|---|---|---|
| | A | B | C | D |
| Sheet feeding port 3 | | | | |
| Paper type detection | To be detected | To be detected | Not to be detected | Not to be detected |
| Double feed detection | To be detected | Not to be detected | To be detected | Not to be detected |
| Backing sheet setting Yes | | | | |
| Sheet feeding port 4 | | | | |
| Paper type detection | To be detected | To be detected | Not to be detected | Not to be detected |
| Double feed detection | To be detected | Not to be detected | To be detected | Not to be detected |
| Backing sheet setting No | | | | |
| <Sheet feeding port n> | | | | |
| Paper type detection | To be detected | To be detected | Not to be detected | Not to be detected |
| Double feed detection | To be detected | Not to be detected | To be detected | Not to be detected |
| Backing sheet setting No | | | | |

TABLE 3

| Transmitted light quantity information Rz | |
|---|---|
| Sheet feeding port 1 | Rz1 |
| Sheet feeding port 2 | Rz2 |
| Sheet feeding port 3 | Rz3 |
| Sheet feeding port 4 | Rz4 |
| . | . |
| . | . |
| . | . |
| Sheet feeding port n | Rzn |

Further, as shown in Table 4, for example, the comparison value Y for storing the measurement value X is managed for each of the medium trays (Y1 to Yn). Therefore, paper type detection can surely be performed even when sheets are fed alternately from different sheet feeding ports. A memory device for storing the comparison value Y may also include the memory for storing the comparison value for each of the medium trays.

TABLE 4

| Comparison value Y | |
|---|---|
| Sheet feeding port 1 | Y1 |
| Sheet feeding port 2 | Y2 |
| Sheet feeding port 3 | Y3 |
| Sheet feeding port 4 | Y4 |
| . | . |
| . | . |
| . | . |
| Sheet feeding port n | Yn |

Further, as shown in FIG. 5, as a transmitted light quantity table (a table having the contents, for example, shown in table 1 according to the previous exemplary embodiment) for each medium, "other: R5" is included as a category in order to address many and various types of mediums for use in the market. In addition to the category, "other", a plurality of categories may be included. A range of transmittance may be optionally set. Setting of a transmitted light quantity of the category, "other: R5" is also made by the transmitted light quantity setting device.

TABLE 5

| Paper type setting | Range of transmitted light quantity Rz | Transmitted light quantity |
|---|---|---|
| OHP | R1 | ↑ High |
| Second original | R2 | \| |
| Plain paper | R3 | \| |
| Thick paper | R4 | ↓ Low |
| Other | R5 | Optional |

Further, when an object (medium) of the paper type detection is a backing sheet, or when the object of the paper type detection is a sheet for back side printing having an image already formed on one side thereof, the medium discrimination (paper type detection and double feed detection) is not to be performed. The medium discrimination is not to be performed in the case because when a position in which transmittance is measured overlaps with a position where the image has already been formed, the transmittance may be incorrectly measured, and the medium discrimination may not be correctly performed (resulting in wrong detection). The above table 2 provisionally includes whether or not the backing sheet setting is made for each of the sheet feeding port 1 to n. The backing sheet setting is made by the operation device as described above, and stored in the memory.

Next, an example operation flow of the medium discrimination device is described below referring to FIGS. 6 and 7. In the FIGs, the same steps as the steps in the example operation flow shown in FIG. 4 according to the previous exemplary embodiment are assigned with the same reference numerals as the reference numerals in FIG. 4. A difference between the flow in FIG. 4 and the flows in FIGS. 6 and 7 is mainly described below. FIG. 6 is a flowchart of control for setting detection conditions. As shown in FIG. 6, medium information is set (step S1), then, operation modes are set (step S18), and a sheet feeding port is set (step S21). The setting of medium information can be previously made for each of the sheet feeding ports in the transmittance information setting device.

The setting of the operation modes is determined by a combination of on and off of the paper type detection switch device, on and off of the double feed detection switch device, and on and off of the backing sheet setting device, which can be previously set. The operation modes are selected from four operation modes, A, B, C, and D, according to the combination shown in table 2. Further, when the backing sheet setting has been turned on, it is mandatory that the operation mode D be selected. For example, as shown in table 2, although the operation mode C is intended for the sheet feeding port 3, the operation mode D is forcibly selected in step 18 in the case because the backing sheet setting has been made (as yes).

In FIG. 7, although basic flows of the paper type detection and the double feed detection are the same as in the flow in FIG. 4, branch conditions in accordance with the operation modes (A, B, C, and D) are provided. In addition, a judgment on whether the sheet feeding port has been reset (step S26) to reset the comparison value Y in a case the sheet feeding port has been reset is added. In step S26, in a case paper or the like is replenished to the sheet feeding port, the comparison value Y is reset so that a routine for the paper type detection is executed.

In the operation mode A, both the paper type detection and the double feed detection are turned on. In the mode, the basic operation flow is the same as in the flow in FIG. 4. In a case of a first sheet, the paper type detection is performed (step S6), and in a case of a following sheet and thereafter, a routine for the double feed detection (step S8) is executed. In the case the sheet is not the first sheet, in other words, the comparison value Y is previously set as a result of a previous job, the flow directly goes to the routine for the double feed detection according to a branch condition of step S5.

In the operation mode B, the paper type detection is turned on, while the double feed detection is turned off. In the mode, in the case of the first sheet, the paper type detection is performed (step S6), and in the case of the following sheet and thereafter, the flow goes to step S11 without executing the double feed detection (step S8) according to a result of a judgment in step S24. In the case the sheet is not the first sheet, in other words, even the comparison value Y is previously set as the result of the previous job, the flow goes to a routine for not executing the double feed detection (S8) by passing through step S8 according to the judgment in step S24.

In the operation mode C, the paper type detection is turned off, while the double feed detection is turned on. In the mode, even in the case of the first sheet, the paper type detection (step S6) is not executed according to the branch condition in step S23. In the case of the following sheet and thereafter, the routine for the double feed detection (S9) is executed. In the case the sheet is not the first sheet, in other words, when the comparison value Y is previously set as the result of the previous job, the flow directly goes to the routine the double feed detection according to the branch condition in step S5.

In the operation mode D, both the paper type detection and the double feed detection are turned off. In the mode, both in the case of the first sheet and in the case of the following sheet and thereafter, the paper type detection and the double feed detection are not executed according to the branch condition in step S22.

Further, in order to avoid the wrong detection which may occur in the case of a sheet having an image already formed on one side thereof, by setting whether a medium stored in a medium tray is a back side sheet (having an image already formed on one side thereof) using the backing sheet setting device, the operation mode D is set to forcibly skip the medium discrimination (step S16).

Further, in a case of a duplex printing process (mainly an interleaf control for alternately performing one sided printing and two sided printing sheet by sheet) in an image forming apparatus such as a copier, the paper type detection is not performed on a medium subjected to back side printing according to the branch condition in step S27 from the same reason. The case applies to when a sheet yet to have an image thereon and a sheet having an image already formed on one side thereof are conveyed through the same route. A case in point is when the medium discrimination device is disposed in the vicinity of the registration roller 23 (where medium conveyance routes meet) shown in FIG. 2.

In the exemplary embodiment, by selectively performing the medium discrimination (the paper type detection and the double feed detection) by using the single transmitted light quantity measurement device, a measurement device (detection device) can be shared, and a mechanism can be simplified, thereby achieving a reduction in cost. Further, control can be simplified, thereby enhancing reliability of a system.

Further, various and many types of mediums can be dealt. As a result, a medium which cannot be detected can be used for copying, and ease of use (degree of freedom) can be improved by addressing various use conditions of users.

Further, random interleaf conveyance from different storages can be achieved. It is possible to avoid inappropriate measurement of transmittance. As a result, efficient control can be achieved (by simplified control), thereby enhancing reliability of a system.

Next, another exemplary embodiment of the present invention is described below. A copier 300 according to the exemplary embodiment of the present invention is based on the copier 200 according to the previous exemplary embodiment. A schematic configuration of the copier 300 is the same as the schematic configuration of the copier 100 shown in FIGS. 1 and 2. Electrical components of the copier 300 is the same as the electrical components of the copier 200 described above referring to FIG. 5, and control of the copier 300 is also the same as the control of the copier 200 described above referring to FIGS. 6 and 7. The copier 300 differs from the copier 200 in that the copier 300 is configured so as to be able to change timing in which a medium following a medium subjected to the paper type detection or the double feed detection is successively brought out from the medium tray.

Figure 8:
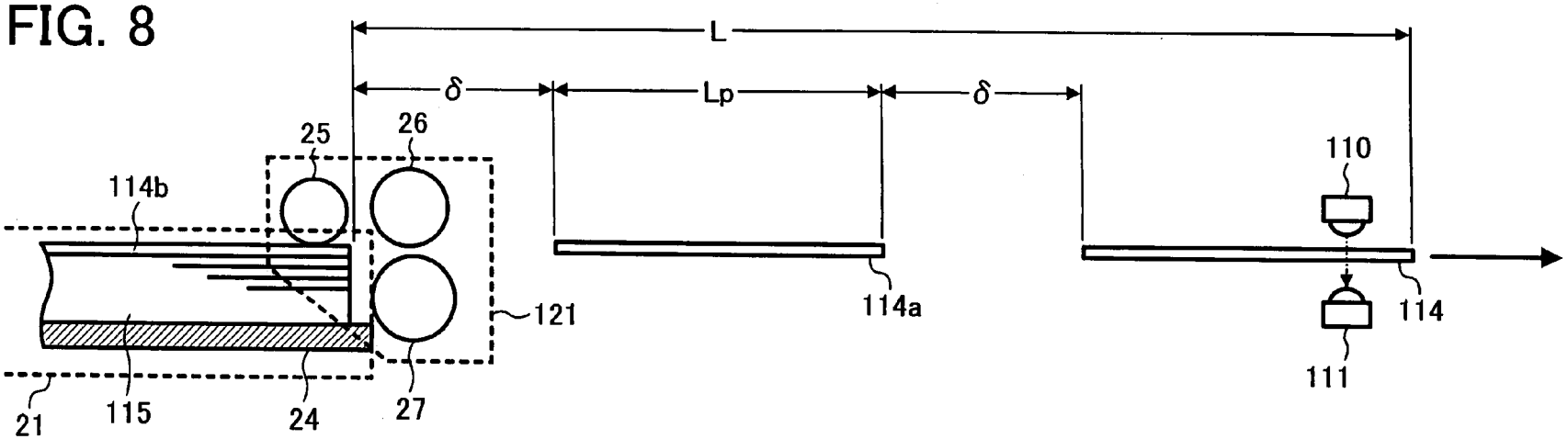
FIG. 8 schematically illustrates an interval between sheets in a state of normal successive conveyance.

FIG. 8 schematically illustrates an interval between sheets (mediums) in a state of normal successive conveyance (successive sheet feeding). Sheets 114 and 114*a*, and a sheet 114*b* on the sheet feeding tray 21 (having a sheet length of Lp) sequentially brought out from the sheet feeding tray 21 are brought onto the conveyance route while keeping a constant interval δ, and are guided into the image forming unit. In a case a distance between the sheet feeding tray and the transmitted light quantity measurement devices 110 and 111 (a measurement unit) is long, when the first sheet 114 arrives at the transmitted light quantity measurement devices 110 and 111, the following sheet 114*a* has already been brought onto the conveyance route. When an error is detected in the medium discrimination in the state (steps S7 and S9 in FIG. 7), a machine is stopped (step S12A in FIG. 7). In the case, the sheet 114*a* which has already been brought out of the sheet feeding tray is dealt as a residual sheet. When an image to be transferred to the following sheet 114*a* has already been transferred onto the intermediate transfer belt 5 shown in FIG. 1, toner is wastefully consumed, and durability of the cleaning device 52 of the intermediate transfer belt 5 is lowered.

Therefore, the above problem is avoided by lengthening the interval between the first sheet subjected to the medium discrimination and the following sheet in the exemplary embodiment of the present invention.

Figure 9:
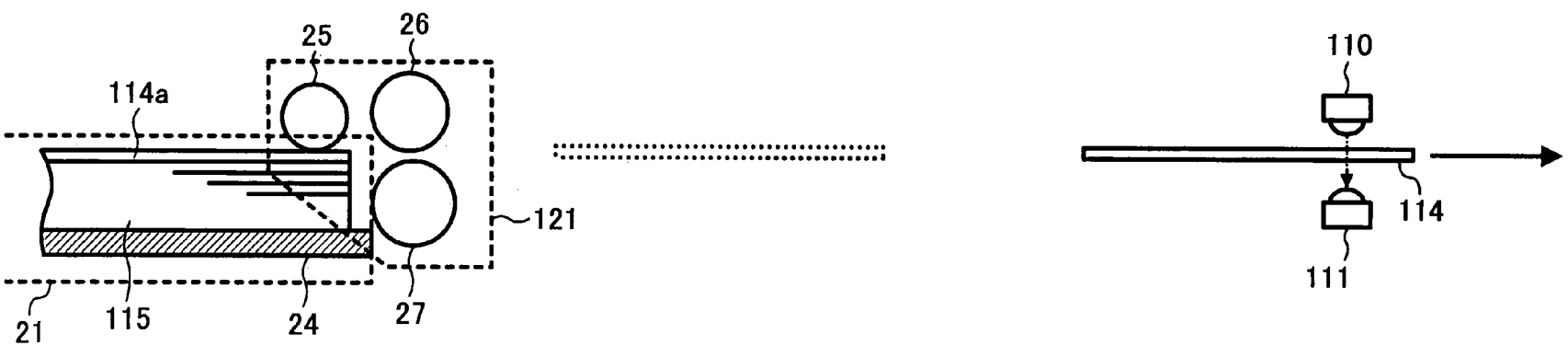
FIG. 9 schematically illustrates an example interval between the sheets in a case the interval is lengthened.

FIG. 9 schematically illustrates an example interval between the sheets in the case the interval is lengthened. By lengthening the interval between the sheet subjected to the paper type detection or the double feed detection and the sheet to be brought out following the sheet by a predetermined amount, the following sheet is yet to be brought onto the conveyance route even in timing when the first sheet 114 arrives at the measurement unit. Even when an error is raised in the detection of the first sheet 114, no sheet is wastefully used (as shown by a broken line at a center in FIG. 9). For the above reason, the copier 300 is configured so as to be able to change the timing in which the sheet following the sheet subjected to the paper type detection or the double feed detection is successively brought out from the medium tray from the timing in normal conveyance. Further, timing of performing exposure, development, transfer, and so forth in the entire image forming unit 1 in FIG. 1 is also changed in accordance with the timing of bringing out the following sheets so as to previously make an interval between images to be formed on the first sheet 114 and the following sheet 114*a* to be the predetermined amount. In the image forming process using the intermediate transfer belt shown in FIG. 1, by changing timing of performing various operations, for example, so as to start transferring the image to be formed on the following sheet 114*a* in the same timing as timing in which feeding of the sheet 114*a* is started, the wasteful consumption of toner and a burden of cleaning may be alleviated.

A condition for an image forming apparatus to make such a change in timing is related to a positional relationship (distances) of the sheet feeding tray 21 and the transmitted light quantity measurement devices 110 and 111. As shown in FIG. 8, when L represents a distance between the devices, Lp represents a length of the sheet, and δ represents an interval between the sheets, the condition satisfies $L>(Lp+\delta)$. When the transmitted light quantity measurement devices 110 and 111 are arranged in the vicinity of the registration roller 23 (in an upstream side) shown in FIG. 1, and the image forming apparatus includes a plurality of sheet storages in a downstream side thereof, the change in the timing is considerably effective since a sheet to be fed from any of the plurality of sheet storages is to be conveyed on a long conveyance route.

The timing of bringing out the sheet following a sheet subjected to the paper type detection and double feed detection comes after timing in which a judgment is made on whether or not the sheet subjected to the detection is normal. The timing is previously determined for each of the plurality of sheet feeding parts, the timing can be previously set for each of the plurality of sheet feeding parts. Further, whether or not the following sheet is brought out may be controlled based on a result of the judgment such that when the sheet is judged to be normal, the following sheet is brought out, and when the sheet is judged to be not normal, the following sheet is not brought out. Further, the change in the timing of bringing out the following sheet may be made for either one of the paper type detection and the double feed detection. For example, the timing of bringing out the following sheet is made only based on the result of the paper type detection.

When the paper type detection is performing only on the first sheet, and the second and following sheets are only subjected to the double feed detection as in the copiers 100 and 200 according to the previous exemplary embodiments, and the above change in the timing is made for the following sheets, it is inevitable that productivity in an initial period of printing is decreased (cannot be secured) due to the lengthened feeding interval between the first sheet and the following sheet. The decrease in the productivity becomes significant as the distance L becomes longer. Therefore, a mode selection mechanism may be provided for a user who puts a high priority on the productivity so that the user can optionally select whether or not the interval between the sheets is lengthened (selectively turn on and off a feeding interval lengthening mode). By using the mechanism, the productivity-oriented user turns off the feeding interval lengthening mode so that sheets are fed by keeping the same interval δ as in a normal continuous feeding operation from the initial period, thereby avoiding the decrease in the productivity. A mode selection unit may include a normal operation unit for an operator, and a control unit for controlling a sequence of each unit such as the image forming unit 1 by using a signal from the operation unit.

Figure 10:
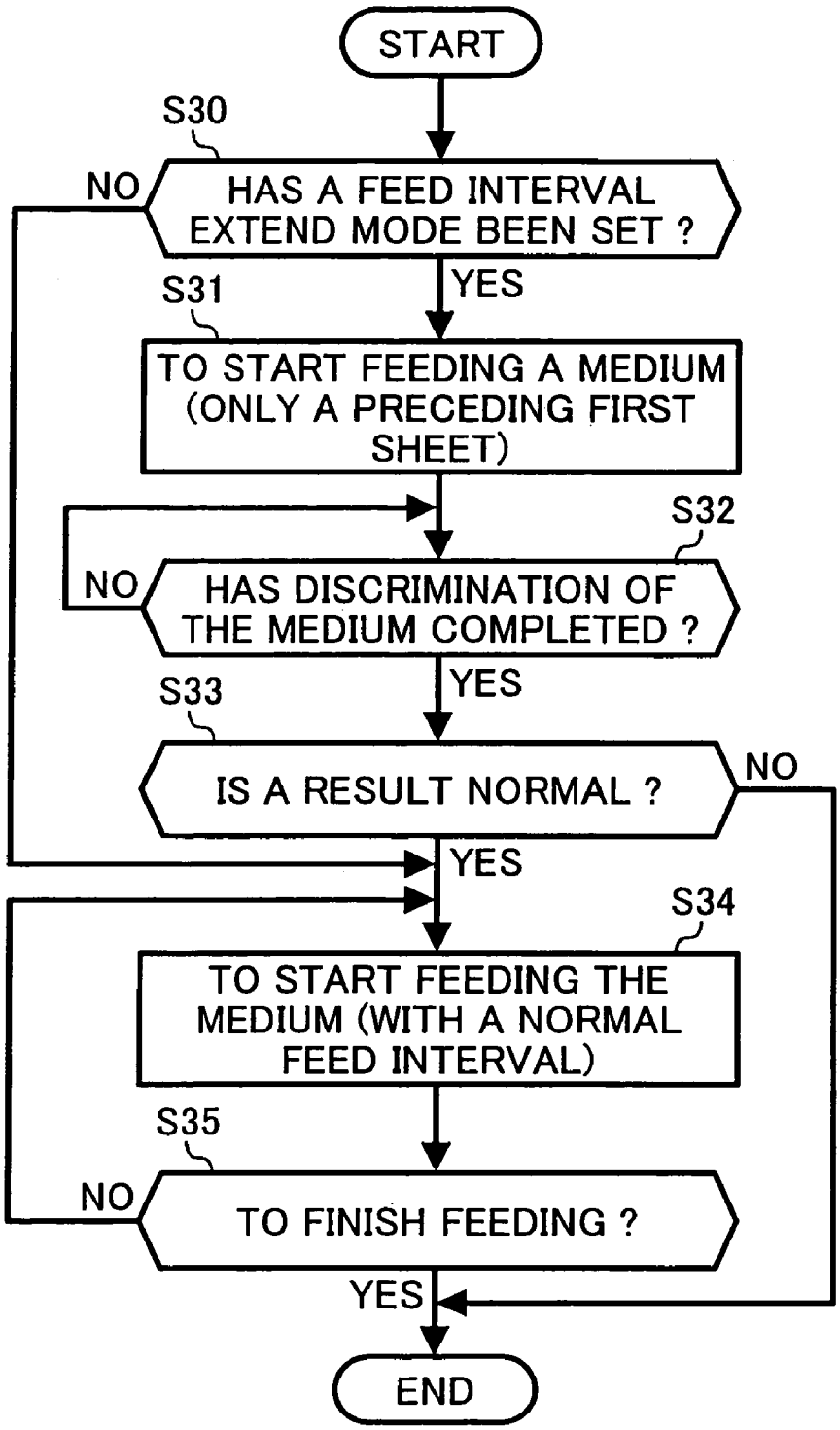
FIG. 10 is an example flowchart of feeding operation control of a copier according to another exemplary embodiment of the present invention.

FIG. 10 is an example flowchart of feeding operation control according to the exemplary embodiment of the present invention.

Whether a mode for lengthening the feed interval is executed is selected by a feed interval lengthening mode setting device. After a print operation is started, based on a judgment made on setting in the feed interval lengthening mode setting device in step S30, when the setting is judged as being on, the feeding interval lengthening mode is adopted, and feeding of only the first sheet is started in step S31. When the setting judged as being off, continuous feeding is performed with the normal feeding interval in step S34 until the feeding is finished (step S35).

When the feeding interval lengthening mode is turned on, a next operation is determined after the medium discrimination (the paper type detection/the double feed detection) on the preceding first sheet is finished (step S32), based on whether or not a result of the medium discrimination is normal (step S33). When the result of the medium discrimination in step S33 is normal, feeding of the following sheets is continued in step S34. Feeding is performed with the normal interval thereafter (step S35). When the result of the medium discrimination is not normal, the flow jumps to step S36, and the feeding operation is finished.

According to the control, since the feeding of the following sheets is not performed unless the medium discrimination of the first sheet is finished, and the result thereof is judged as being normal, the following sheet 114*a* is held on the sheet feeding tray 5. Thus, by lengthening the interval between the preceding sheet subjected to the medium discrimination and the following sheet to be wider than the interval in the normal continuous feeding, even when the result of the medium discrimination is not normal and the operation of a machine is stopped, no medium is wasted in the machine. As a result, resource saving can be achieved, and a bother of dealing with a residual sheet can be eliminated. Further, there is no useless image to be formed on the intermediate transfer belt, resulting in a decrease in consumption of toner, and improvement in durability of a cleaning mechanism. Further, by permitting/executing feeding of the next medium in timing when the preceding medium subjected to the medium discrimination is judged as being normal, simple control can ensure assured operation. Further, since the selection mechanism with which the user is able to optionally select whether or not to execute the lengthening of the interval between the mediums (causing the decrease in the productivity in the initial period) is provided, the normal feeding mode can be selected when the user does not want the productivity to be decreased.

As described in the exemplary embodiment using the copier 200, the various types of modes shown in table 2 are provided to determine whether or not the paper type detection and the double feed detection are performed. Therefore, the control for changing the timing of bringing out the following sheet may be executed only when the paper type detection or the double feed detection is performed on the preceding sheet.

Further, the control for changing the timing of bringing out the following sheet can be applied to the copier 100 according to the exemplary embodiment of the present invention.

Next, another exemplary embodiment of the present invention is described below. A copier 400 according to the exemplary embodiment is based on the copiers 100 to 300 according to the previous exemplary embodiments and added with the following improvement.

For example, as shown in FIG. 1, when the image forming unit is provided with the transmitted light quantity measurement devices 110 and 111 disposed at a registration part where a conveyance route for substantially horizontally conveying a medium from the manual feeding tray 120 and a conveyance route for substantially vertically conveying a medium from a medium feeding device 121 meet, a problem described below may occur. In other words, as magnified in FIGS. 11A and 11B, the medium being conveyed, of which leading edge abuts on the registration roller 23 at the registration part to form a sag. Then, the medium is temporarily stopped with the sag to be aligned with a position of an image to adjust the timing of feeding the medium to the image forming unit. Before the leading edge abuts on the registration roller 23, a track of the sheet is not stable. Even after the leading edge abuts thereon, a positional relationship with the transmitted light quantity measurement devices 110 and 111 varies every moment while an amount of the sag varies every moment. When measurement is performed by using the transmitted light quantity measurement devices 110 and 111 in such a period, a measurement error may grow.

In the exemplary embodiment of the present invention, a transmitted light quantity is measured when forming of the sag is finished (temporarily stopped). Thus, a posture of the medium is stabled to enhance accuracy in the measurement of transmittance.

Figure 11B:
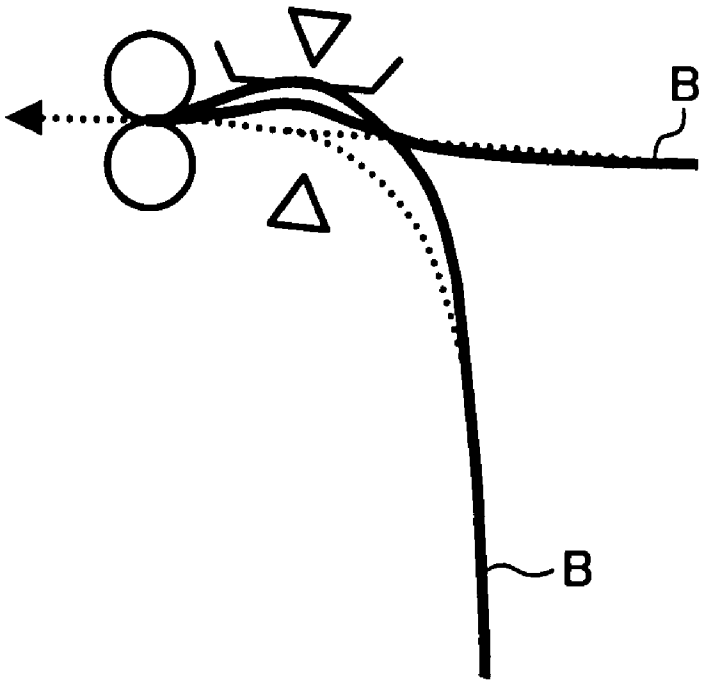
FIGS. 11A and 11B are magnified views each illustrating a medium being conveyed, of which leading edge abuts on a registration roller at a registration part to form a sag.

Further, as shown in FIG. 11B, depending on a type of the medium, the same medium may differ in formation (tendency) of a sag between the conveyance route for substantially horizontally conveying the medium and the conveyance route for substantially vertically conveying the medium. The difference dominantly appears when a thick medium which hardly forms a sag is used. To address the difference, an information table of previously set medium information is set for each of the plurality of conveyance routes which meet before the registration part so that accuracy in detection of a medium in the medium discrimination is assured even when the same medium is conveyed on a different route.

Figure 11A:
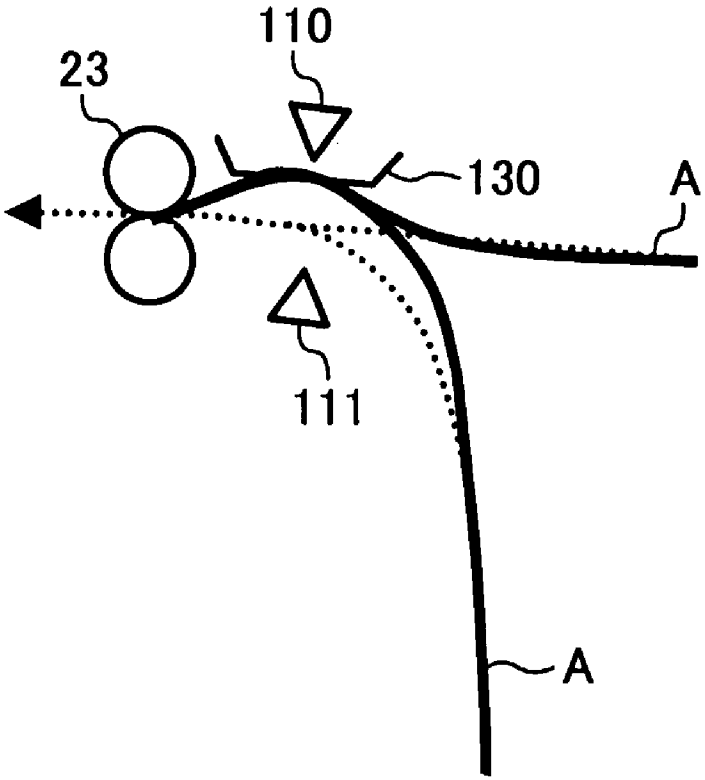

Specific description is provided below. In FIG. 11A, the leading edge of the medium being conveyed abuts on the registration roller 23 in a stopped state, and enters a temporary stopped state with the sag. In the timing, a posture (amount) of the sag is restricted into a specific posture by an upper guide plate 130 arranged in front of the registration part. In the timing, the measurement of the transmitted light quantity is performed. Since the transmitted light quantity measurement devices 110 and 111 are disposed in a position where the transmitted light quantity measurement devices 110 and 111 are restricted by the upper guide plate 130, a distance between the measurement devices and the medium can be kept constant, thereby enhancing accuracy in the measurement. Further, by performing the measurement when the medium is in the stopped state, variations in the measurement may be reduced, thereby further enhancing the accuracy in the measurement.

As shown in FIG. 11A, in a case of a thin medium of a plain paper level, each guide shape is provided so that the sag of thin medium A has the same shape in a case the medium A is substantially horizontally conveyed from a right hand side in FIG. 11A (from the manual feeding tray) and in a case the medium A is substantially vertically conveyed from a lower side (the sheet feeding device). In the two cases, positional relationships between the thin medium A restricted by the upper guide plate 130 and the measurement device 110 are the same, resulting in the same measurement result even when the medium A is conveyed through the different conveyance routes. In a case of thick medium B having certain strength as a sheet, however, a sag of the thick medium B has a different shape when conveyed from the lower side as shown in FIG. 11B. In a case the thick medium B is conveyed from the lower side, the thick medium B is likely to form a sag as the thick medium B is conveyed by being previously curbed toward the registration roller 23. On the other hand, in a case the thick medium B is horizontally conveyed, the thick medium B hardly forms a sag, as the thick medium B comes substantially straight toward the registration roller 23. In the two cases, the same thick medium B has different measurement values. Therefore, when the table having the previously set transmittance information is shared in the two cases, wrong detection may be caused. To avoid the wrong detection, the transmitted light quantity information table is provided for each of the conveyance routes (medium storages) as show in FIG. 6. As a result, the wrong detection may be avoided, and accuracy in recognition of the medium can be secured. The above improvement can be applied not only to the copiers 100 to 300 according to the exemplary embodiments of the present invention, but to a general image forming apparatus for performing measurement using light.

TABLE 6A

| Conveyance route 1 (Medium feeding device 1 to N) | |
|---|---|
| Paper type setting | Range of transmitted light quantity Rz |
| OHP | R1 |
| Second original | R2 |
| Plain paper | R3 |
| Thick paper 1 | R4 |
| Thick paper 2 | R5 |

TABLE 6B

| Conveyance route 2 (Manual feeding port) | |
|---|---|
| Paper type setting | Range of transmitted light quantity Rz |
| OHP | R1 |
| Second original | R2 |
| Plain paper | R3 |
| Thick paper 1 | R6 |
| Thick paper 2 | R7 |

Numerous additional modifications and variations are possible in light of the above teachings. It is therefore to be understood that the exemplary embodiments of the invention may be practiced otherwise than as specifically described herein.

What is claimed is:

1. A printing medium discrimination device, comprising:

a transmitted light quantity measurement device configured to measure a transmitted light quantity in a thickness direction of a printing medium on a conveyance route, and configured to perform a measurement of the transmitted light quantity each time the printing medium is conveyed;

a measurement value memory device configured to store a result of the measurement performed by the transmitted light quantity measurement device;

a medium setting device configured to previously set a type of printing medium to be used;

a medium information memory device configured to store information of a transmitted light quantity assigned to each printing medium to be set by the medium setting device; and a control processing unit configured to perform paper type detection on a first printing medium, and double feed detection on following printing mediums.

2. The printing medium discrimination device according to claim 1, wherein the measurement value memory device is configured to rewrite memory contents each time measurement is performed by the transmitted light quantity measurement device on a printing medium conveyed on the conveyance route, and the control processing unit is configured to perform the paper type detection based on comparison between a result of the measurement by the transmitted light quantity measurement device and memory contents written by the medium information memory device in accordance with a printing medium set by the medium setting device, and performs the double feed detection by using the memory contents written by the measurement value memory device.

3. The medium discrimination device according to claim 1, wherein the first conveyed printing medium is a medium first conveyed after a predetermined event in which a printing medium stored in a storage may be replaced.

4. The medium discrimination device according to claim 3, further comprising:

a reset device configured to reset a value stored in the measurement value memory device after the predetermined event; and a mode judgment device configured to perform selected one of the paper type detection and the double feed detection depending on whether a value is set in the measurement value memory device.

5. An image forming apparatus, comprising:

a conveyance route on which a printing medium is conveyed one by one after being separated from a plurality of printing mediums and brought out of a storage in which the printing mediums are overlaid; and a medium discrimination device, wherein said medium discrimination device includes a transmitted light quantity measurement device configured to measure a transmitted light quantity in a thickness direction of a printing medium on a conveyance route, and configured to perform a measurement of the transmitted light quantity each time the printing medium is conveyed, a measurement value memory device configured to store a result of the measurement performed by the transmitted light quantity measurement device, a medium setting device configured to previously set a type of medium to be used, a medium information memory device configured to store information of a transmitted light quantity assigned for each printing medium to be set by the medium setting device, and a control processing unit configured to perform paper type detection on a first printing medium, and double feed detection on following printing mediums.

6. The image forming apparatus comprising the medium discrimination device according to claim 5, wherein the medium discrimination device further comprises:

at least one of a recording medium storage attachable to and detachable from the image forming apparatus, wherein attachment and detachment thereof is detected, and a storage member variably attached to the image forming apparatus, wherein presence of a printing medium stored therein is detected, and the first conveyed printing medium is a printing medium first conveyed after a predetermined event in which the printing medium stored in a storage may be replaced.

7. The image forming apparatus according to claim 5, further comprising:

a storage configured to store a printing medium; and a device configured to bring out the printing medium from the storage, wherein the image forming apparatus is configured to change timing of successively bringing out from the storage a printing medium following a printing medium subjected to selected one of the paper type detection and the double feed detection.

8. The image forming apparatus according to claim 7, further comprising:

a control device configured to make a judgment on whether respective results of the paper type detection and the double feed detection are normal, and to at least partially stop an image forming operation when the results are determined to be not normal, wherein the image forming apparatus is configured to be able to change the timing of bringing out the printing medium between timing which comes after the judgment is made on the printing medium subjected to the detection, and predetermined timing which comes earlier than the timing.

9. The image forming apparatus according to claim 8, wherein the timing, which comes after the judgment is made, is when the result is determined to be normal, and when the result is determined to be not normal, the printing medium is not brought out.

10. The image forming apparatus according to claim 8, further comprising:

a selection device configured to select whether to change timing of successively bringing out a printing medium following a printing medium subjected to selected one of the paper type detection and the double feed detection, wherein the predetermined timing which comes earlier refers to the timing for bringing out the printing medium when not performing the change is selected.

11. A printing medium discrimination device, comprising:

a transmitted light quantity measurement device configured to measure a transmitted light quantity in a thickness direction of a printing medium on a conveyance route, and configured to perform a measurement of the transmitted light quantity when the printing medium is conveyed;

a measurement value memory device configured to store a result of the measurement of the transmitted light quantity performed by the transmitted light quantity measurement device;

a medium information memory device configured to store information of a transmitted light quantity in accordance with a printing medium previously set for use; and a control processing unit configured to selectively perform paper type detection and double feed detection based on a result of a comparison between the transmitted light quantity measured by the transmitted light quantity measurement device and selected one of the transmitted light quantity corresponding to the printing medium previously set in the medium information memory device and the transmitted light quantity stored by the measurement value memory device, and to selectively perform the paper type detection and the double feed detection according to predetermined timing.

12. The medium discrimination device according to claim 11, wherein the predetermined timing is when a first printing medium is conveyed, and the control processing unit is configured to perform the paper type detection in the timing.

13. The medium discrimination device according to claim 11, wherein the predetermined timing is when a printing medium following the first printing medium is conveyed, and the control processing unit is configured to perform the double feed detection in the timing.

14. The medium discrimination device according to claim 11, further comprising:

a medium setting device configured to previously set a type of printing medium to be used, wherein information of a transmitted light quantity assigned to each printing medium by the medium setting device can be optionally set to the medium information memory device.

15. The medium discrimination device according to claim 11, further comprising an operation device configured to set whether the paper type detection to be performed in the predetermined timing is actually performed.

16. The medium discrimination device according to claim 11, further comprising an operation device configured to set whether the double feed detection to be performed in the predetermined timing is actually performed.

17. The medium discrimination device according to claim 11, wherein a plurality of measurement value memory devices are provided for a plurality of storages each storing a printing medium from which the printing medium is selectively brought out on the conveyance route.

18. The medium discrimination device according to claim 17, further comprising a plurality of operation devices, wherein each one of the plurality of operation devices is configured to set for a corresponding one of the plurality of storages whether the double feed detection to be performed in the predetermined timing is actually performed.

19. The medium discrimination device according to claim 11, wherein a plurality of medium information memory devices are provided for the plurality of storages each storing the printing medium from which the printing medium is selectively brought out on the conveyance route.

20. The medium discrimination device according to claim 19, further comprising a plurality of operation devices, wherein each one of the plurality of operation devices is configured to set for a corresponding one of the plurality of storages whether the paper type detection to be performed in the predetermined timing is actually performed.

21. The medium discrimination device according to claim 20, wherein an information table for the medium information memory device is provided for each of a plurality of medium conveyance routes.

22. The medium discrimination device according to claim 20, wherein an information table for the medium information memory device is provided for each storage.

23. A printing medium feeding device, comprising:

a storage configured to store a printing medium;

a device configured to bring out the printing medium in the storage; and a medium discrimination device, wherein said medium discrimination device includes a transmitted light quantity measurement device configured to measure a transmitted light quantity in a thickness direction of a printing medium on a conveyance route, and configured to perform a measurement of the transmitted light quantity when the printing medium is conveyed, a measurement value memory device configured to store a result of the measurement of the transmitted light quantity performed by the transmitted light quantity measurement device, a medium information memory device configured to store information of a transmitted light quantity in accordance with a printing medium previously set for use, and a control processing unit configured to selectively perform paper type detection and double feed detection based on a result of a comparison between the transmitted light quantity measured by the transmitted light quantity measurement device and selected one of the transmitted light quantity corresponding to the printing medium previously set in the medium information memory device and the transmitted light quantity stored by the measurement value memory device, and to selectively perform the paper type detection and the double feed detection according to predetermined timing.

24. An image forming apparatus, comprising:

a medium discrimination device wherein said medium discrimination device includes a transmitted light quantity measurement device arranged to measure a transmitted light quantity in a thickness direction of a printing medium on a conveyance route, and configured to perform a measurement of the transmitted light quantity when the printing medium is conveyed, a measurement value memory device storing a result of the measurement of the transmitted light quantity performed by the transmitted light quantity measurement device, a medium information memory device storing information of a transmitted light quantity in accordance with a printing medium previously set for use, and a control processing unit configured to selectively perform paper type detection and double feed detection based on a result of a comparison between the transmitted light quantity measured by the transmitted light quantity measurement device and selected one of the transmitted light quantity corresponding to the printing medium previously set in the medium information memory device and the transmitted light quantity stored by the measurement value memory device, and to selectively perform the paper type detection and the double feed detection according to predetermined timing.

25. The image forming apparatus according to claim 24, wherein the control processing unit is configured to perform one of paper type detection and double feed detection when the predetermined timing is when a medium, having an image printed on one side thereof, is conveyed.

26. A printing medium discrimination method, comprising the steps of:

measuring a transmitted light quantity in a thickness direction of a printing medium on a conveyance route when the printing medium is conveyed;

storing a measurement value being a result of the measurement of the transmitted light quantity performed in the step of measuring the transmitted light quantity;

storing information of a transmitted light quantity in accordance with a printing medium previously set for use; and selectively performing paper type detection and double feed detection based on a result of a comparison between the transmitted light quantity measured in the step of measuring the transmitted light quantity and selected one of the transmitted light quantity corresponding to the printing medium previously set in the step of storing information of the transmitted light quantity and the transmitted light quantity stored in the step of storing the measurement value, and selectively performing the paper type detection and the double feed detection according to predetermined timing.

27. A printing medium discrimination device comprising:

means for measuring a transmitted light quantity in a thickness direction of a printing medium on a conveyance route, and for performing a measurement of the transmitted light quantity when the printing medium is conveyed;

means for storing a result of the measurement of the transmitted light quantity performed by the means for measuring;

means for previously setting a type of printing medium to be used;

means for storing information of a transmitted light quantity in accordance with a printing medium previously set for use by the means for previously setting; and means for performing paper type detection on a first printing medium, and double feed detection on following printing mediums.

28. A printing medium discrimination device, comprising:

means for measuring a transmitted light quantity in a thickness direction of a printing medium on a conveyance route, and for performing a measurement of the transmitted light quantity when the printing medium is conveyed;

means for storing a result of the measurement of the transmitted light quantity performed by the means for measuring;

means for storing information of a transmitted light quantity in accordance with a printing medium previously set for use; and means for performing paper type detection and double feed detection based on a result of a comparison between the transmitted light quantity measured by the means for measuring and selected one of the transmitted light quantity corresponding to the medium previously set in the means for storing information and the transmitted light quantity stored by the means for storing a result, and for selectively performing the paper type detection and the double feed detection according to predetermined timing.

29. A printing medium discrimination device, comprising:

a transmitted light quantity measurement device configured to measure a transmitted light quantity in a thickness direction of a printing medium on a conveyance route, disposed in vicinity of a registration device where a plurality of conveyance routes meet, and configured to perform a measurement of the transmitted light quantity when the printing medium is temporarily stopped by the registration device;

a measurement value memory device configured to store a result of the measurement of the transmitted light quantity performed by the transmitted light quantity measurement device;

a medium information memory device configured to store information of a transmitted light quantity in accordance with a printing medium previously set for use; and a control processing unit configured to selectively perform paper type detection and double feed detection based on a result of a comparison between the transmitted light quantity measured by the transmitted light quantity measurement device and selected one of the transmitted light quantity corresponding to the printing medium previously set in the medium information memory device and the transmitted light quantity stored by the measurement value memory device.

30. A computer readable recording medium including computer executable instructions, wherein the instructions, when executed by a processor, cause the processor to perform a method comprising the steps of:

measuring a transmitted light quantity in a thickness direction of a printing medium on a conveyance route when the printing medium is conveyed;

storing a measurement value being a result of the measurement of the transmitted light quantity performed in the step of measuring the transmitted light quantity;

storing information of a transmitted light quantity in accordance with a printing medium previously set for use; and selectively performing paper type detection and double feed detection based on a result of a comparison between the transmitted light quantity measured in the step of measuring the transmitted light quantity and selected one of the transmitted light quantity corresponding to the printing medium previously set in the step of storing information of the transmitted light quantity and the transmitted light quantity stored in the step of storing the measurement value, and selectively performing the paper type detection and the double feed detection according to predetermined timing.

31. A printing medium discrimination method, comprising the steps of:

measuring a transmitted light quantity in a thickness direction of a printing medium on a conveyance route when the printing medium is temporarily stopped by a registration device;

storing a measurement value being a result of the measurement of the transmitted light quantity performed in the step of measuring the transmitted light quantity;

storing information of a transmitted light quantity in accordance with a printing medium previously set for use; and selectively performing paper type detection and double feed detection based on a result of a comparison between the transmitted light quantity measured in the step of measuring the transmitted light quantity and selected one of the transmitted light quantity corresponding to the printing medium previously set in the step of storing information of the transmitted light quantity and the transmitted light quantity stored in the step of storing the measurement value.

* * * * *